United States Patent [19]

Field

[11] 4,222,258

[45] Sep. 16, 1980

[54] MILL STAND

[75] Inventor: Michael F. Field, Oshawa, Canada

[73] Assignee: Co-Steel International Limited, Whitby, Canada

[21] Appl. No.: 961,756

[22] Filed: Nov. 17, 1978

[51] Int. Cl.[3] ..... B21B 13/08; B21B 31/08

[52] U.S. Cl. ..... 72/239; 72/244

[58] Field of Search ..... 72/238, 239, 244, 225, 72/245

[56] References Cited

U.S. PATENT DOCUMENTS

| | | | |
|---|---|---|---|
| 749,745 | 1/1904 | Philp | 72/239 |
| 1,004,771 | 10/1911 | Gibbons | 72/244 X |
| 1,544,572 | 7/1925 | George | 72/244 |
| 2,601,793 | 7/1952 | Wood | 72/239 |
| 3,171,304 | 3/1965 | Sims et al. | 72/238 |
| 3,345,848 | 10/1967 | Henschker | 72/244 X |
| 3,491,571 | 1/1970 | O'Brien | 72/244 |
| 3,585,831 | 6/1971 | Lemper | 72/239 |
| 3,626,740 | 12/1971 | Hinterholzl | 72/244 |
| 3,665,746 | 5/1972 | Eibe | 72/239 |
| 3,691,809 | 9/1972 | Hlafesak | 72/238 X |

*Primary Examiner*—Milton S. Mehr

[57] ABSTRACT

A mill stand for steel rolling has a mill housing which allows installation and removal of a roll assembly in a direction transverse to the intended direction of steel through the mill stand. The housing is provided with means for locating and clamping the roll assembly in place and for releasing said clamping to allow removal of the assembly.

6 Claims, 12 Drawing Figures

MILL STAND

Figures 1, 1A:
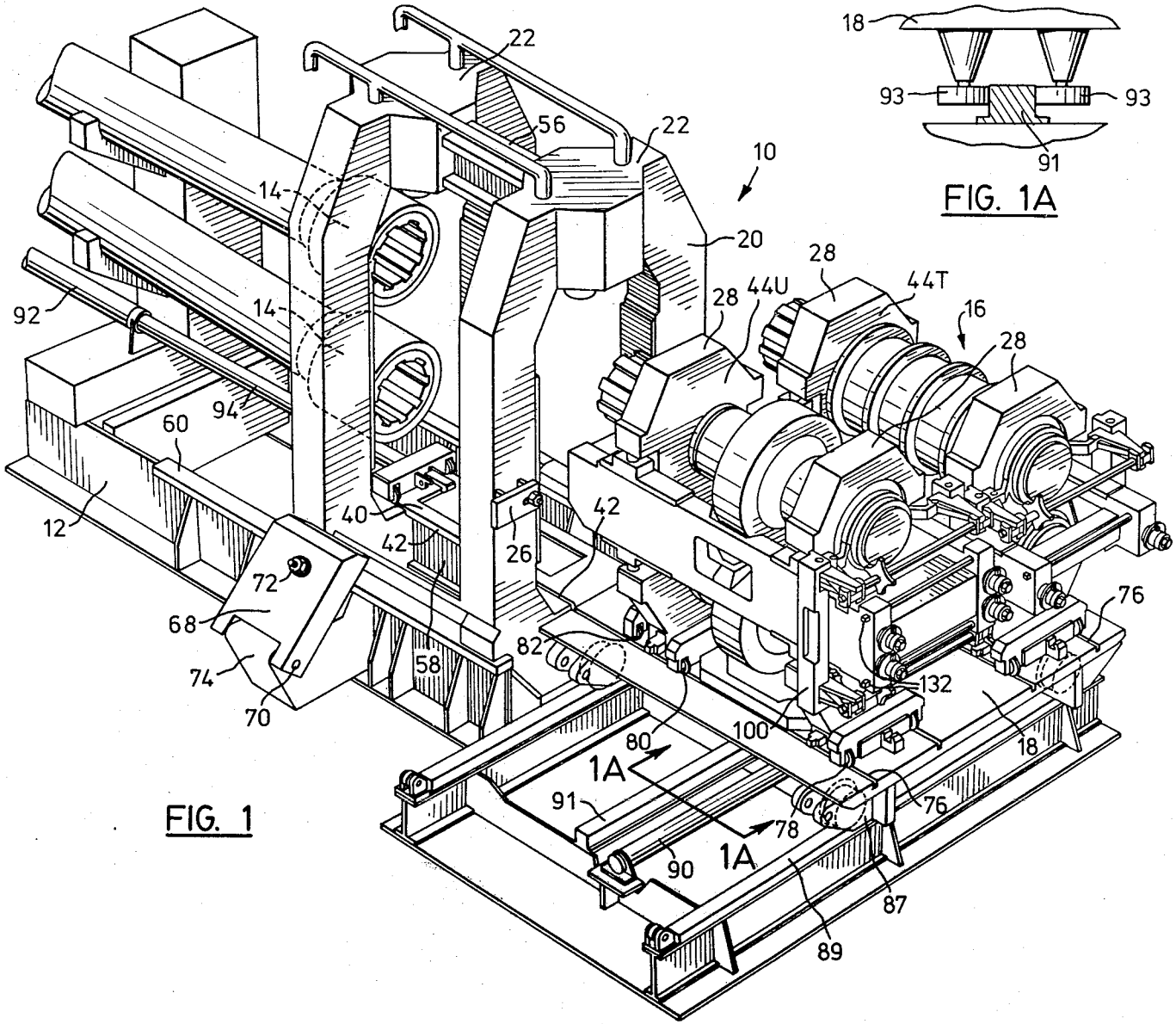

This invention relates to means and a method for producing a variety of shapes in a single rolling unit using different roll configurations by changing the rolls in the rolling mill and to a design for roll guide assemblies allowing such change and allowing pre adjustment of the rolls.

It is an object of this invention to provide roll assemblies designed for easily removal of a roll assembly from a rolling mill and replacing it with another roll assembly. Such replacement includes replacing a pair of horizontally disposed rollers for rolling flat sheets, round bars, or other shape, often called a 'two hi' configuration with an assembly of two vertical and two horizontal rolls, often called a 'universal' configuration; or vice versa.

By the term 'horizontal rolls' is meant rolls with horizontal axes and by the term 'vertical rolls' is meant rolls with vertical axes. Such terms are used in the claims and disclosure.

It is an object of the invention to provide roll assemblies which may be pre adjusted for spacing and attitude before attachment to the mill housing, or thereafter.

It has been possible to exchange such mill roll assemblies previously but such exchange in the past has required the use of cranes or other auxiliary lifting devices and considerable manual labour and consequent long time period.

The present invention allows the substitution of the various roll assemblies without the use of such cranes or lifting devices.

It is an object of the invention to provide means and a method for replacing roll assemblies and assemblies allowing such replacement wherein the roll assemblies may be preassembled in the universal, or two hi in a range of sizes or other configuration, complete with guides and allows pre-setting of the mill roll gaps such that set up times in the mill line are eliminated.

It is an object of the invention to provide a mill housing which may be hydraulically loaded in such a manner as to produce a pre stress in that housing and roll assembly, which reduces the mill "spring" that is the deflection under load in the metal rolling operation. Hydraulic pre-loading is not new to rolling mills technology but is new in combination with replaceable roll assemblies as designed herein.

No search has been performed prior to the filing of this application. However it is known that replaceable roll assemblies have previously been used in hot strip mills and slabbing and blooming mills. However, such known prior assemblies have been of different design and have not allowed precise off-line setting of the height and attitude of the rolls or guides.

In relation to the advantages of the invention and its provision of pre-assembled and pre-adjusted roll assemblies it is noted that mills constructed previously for production of structural shapes historically required considerable time and man hours to be modified from the arrangement from rolling one shape to the arrangement for rolling another or to replace a worn or damaged set of rolls by another set. Although the prior art has suggested various expedients for overcoming this delay of substitution or replacement, such expedients have required considerable additional equipment and expense. For example, one expedient was to provide a complete duplicate mill stand which, when changes were required, was removed complete from the mill line for replacement, by crane, and a duplicate unit substituted in the same manner. This operation might require the use of a crane as large as 500 tons or more with consequent need for heavy building structures.

A further prior art expedient was a method wherein mill stands were substituted on the line by dragging or rolling the stands complete from the mill line to an adjacent area. This method was slow, due to the large masses to be moved and also expensive, and further suffered from the disadvantage that the spare stands were normally parked in front of the operating mill line reducing access and increasing safety hazards.

A third method used in the prior art was to build the mill stands in dismountable sections which, when a change was required, were designed to allow the sections to be removed and reassembled piece-by-piece to effect the required changeover. This method was slow and required setting of the rolls to be made on the line after final assembly.

The mill designed herein disclosed avoids the disadvantages of prior art methods including those specifically referred to above and allows the effecting of the substitution of roll assemblies with a crane of the normal rating used as a service crane in plants having mills of this type. Since the invention involves the movement of masses which are considerably reduced in comparison to the masses under the prior art methods, the substitution and movement may be effected much faster. In accord with the invention the distances travelled by the assemblies being substituted is also mimimal. The operation of changing is simple and may be effected in 10 to 15 minutes in the medium structural mill size.

Important features of the invention include the fact that two roll assemblies containing the necessary roll configurations may be housed on a platform moveable to position one or the other assembly for sliding into or out of the mill stand in a direction transverse to the intended path of the steel. Thus the existing roll assembly in the mill stand may be slid out and a new assembly slid in. Thus it is easy to replace a two-hi configuration with a universal configuration or vice versa. The roll assemblies may be provided complete with guides and strippers and such assemblies may be rapidly exchanged and with a capital cost significantly less than the existing continuous structural designs.

Figure 2:
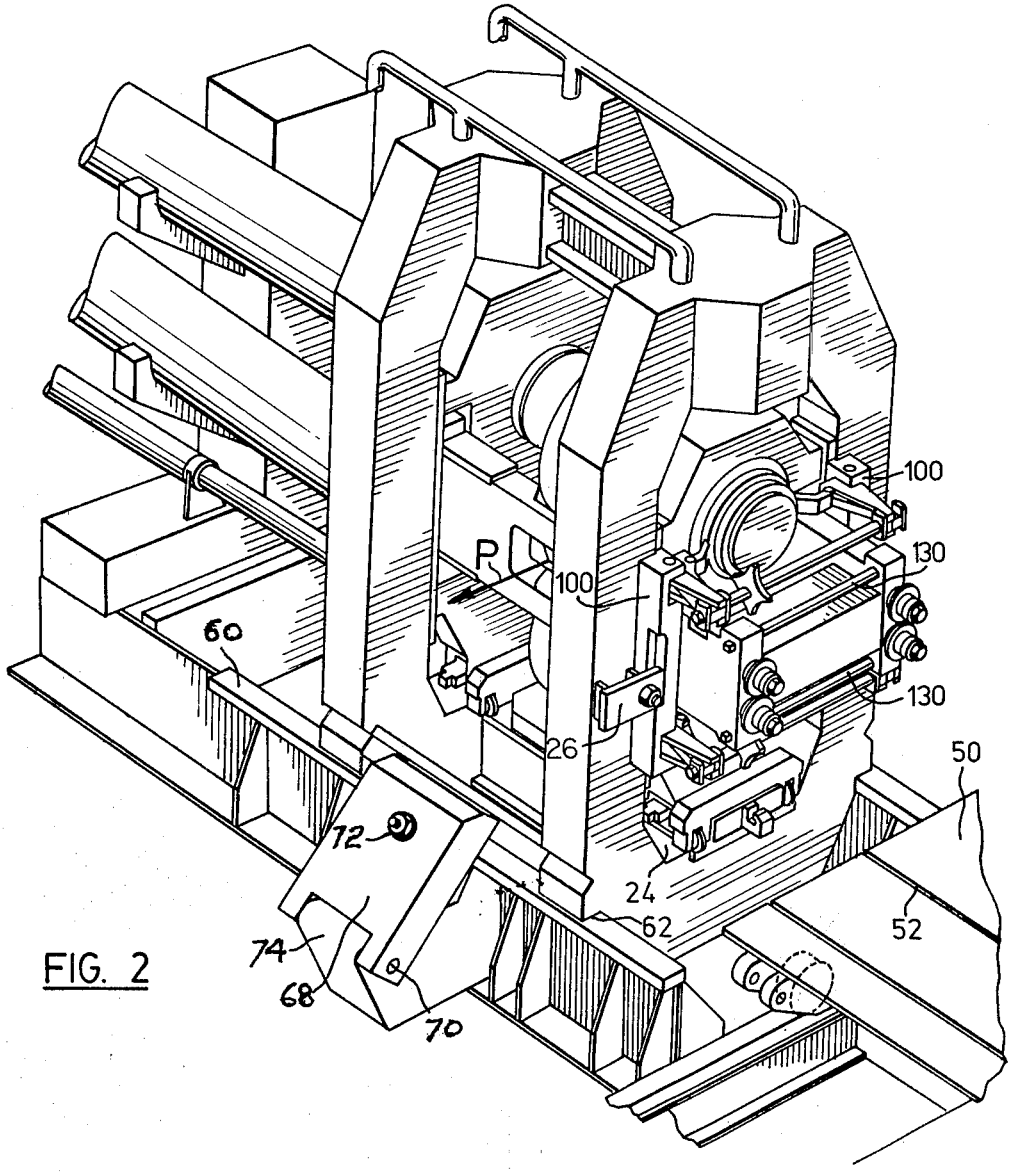
Figure 6:
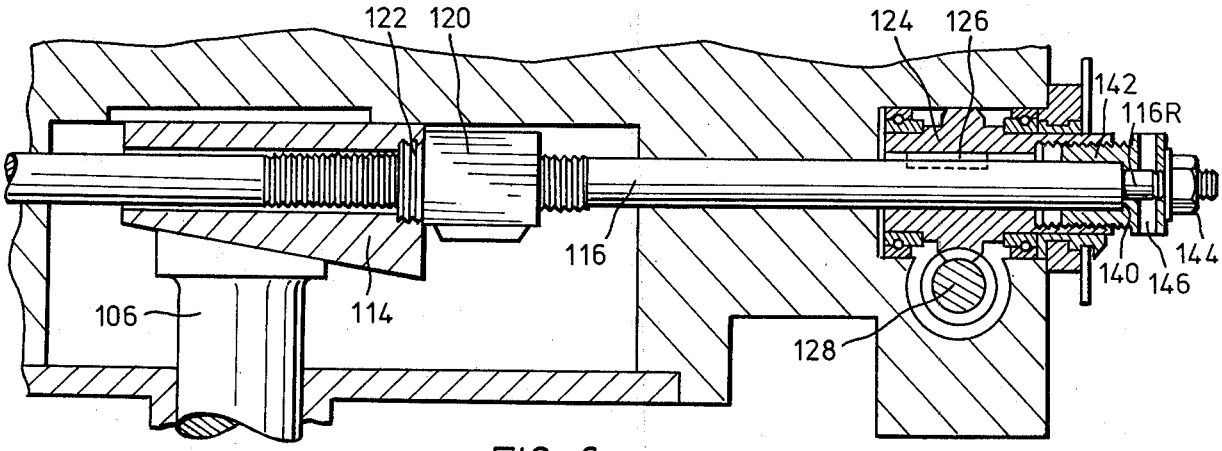
Figure 4:
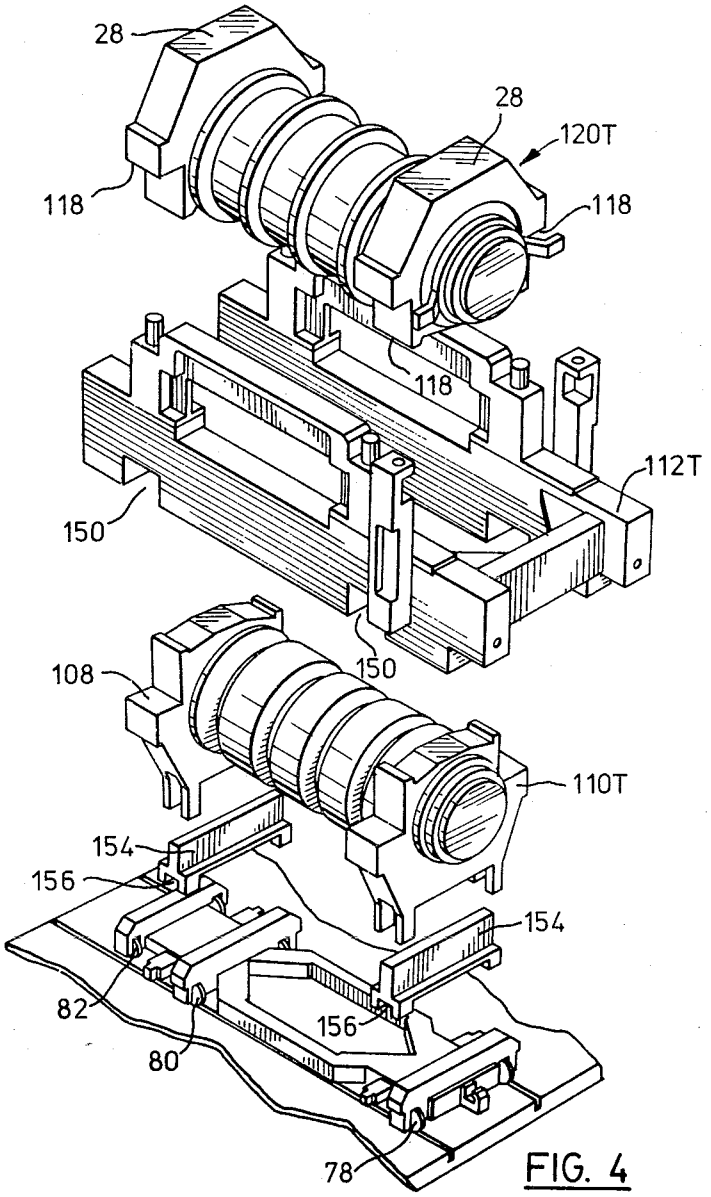
Figure 3:
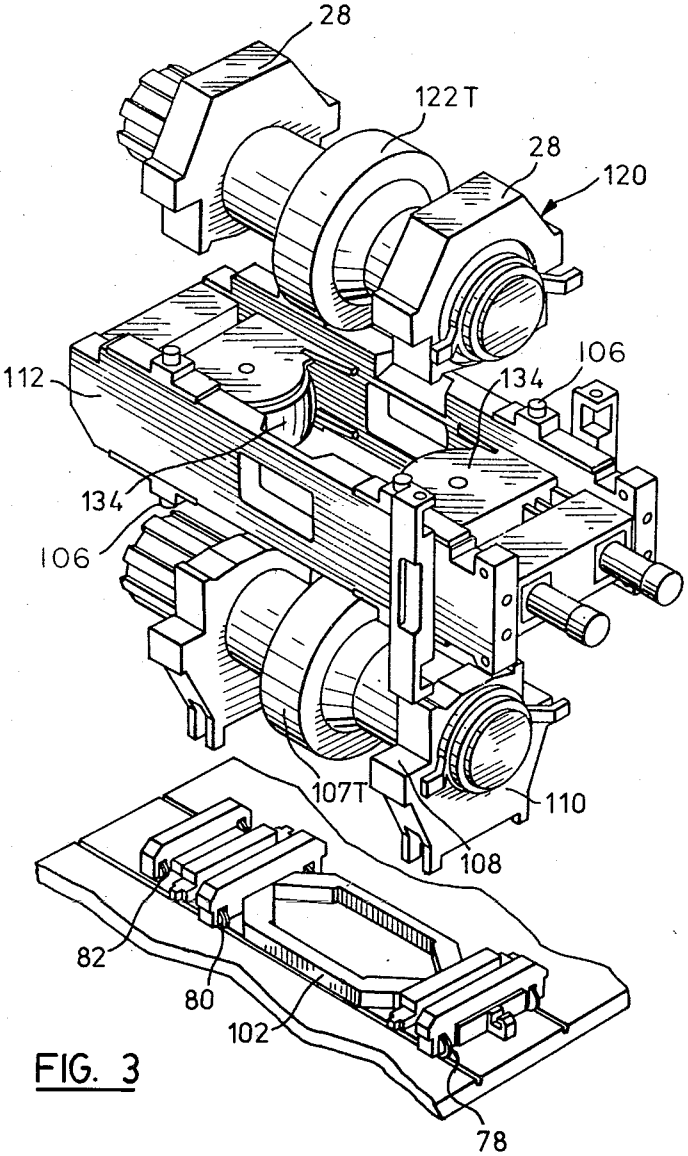
Figures 5, 5A:
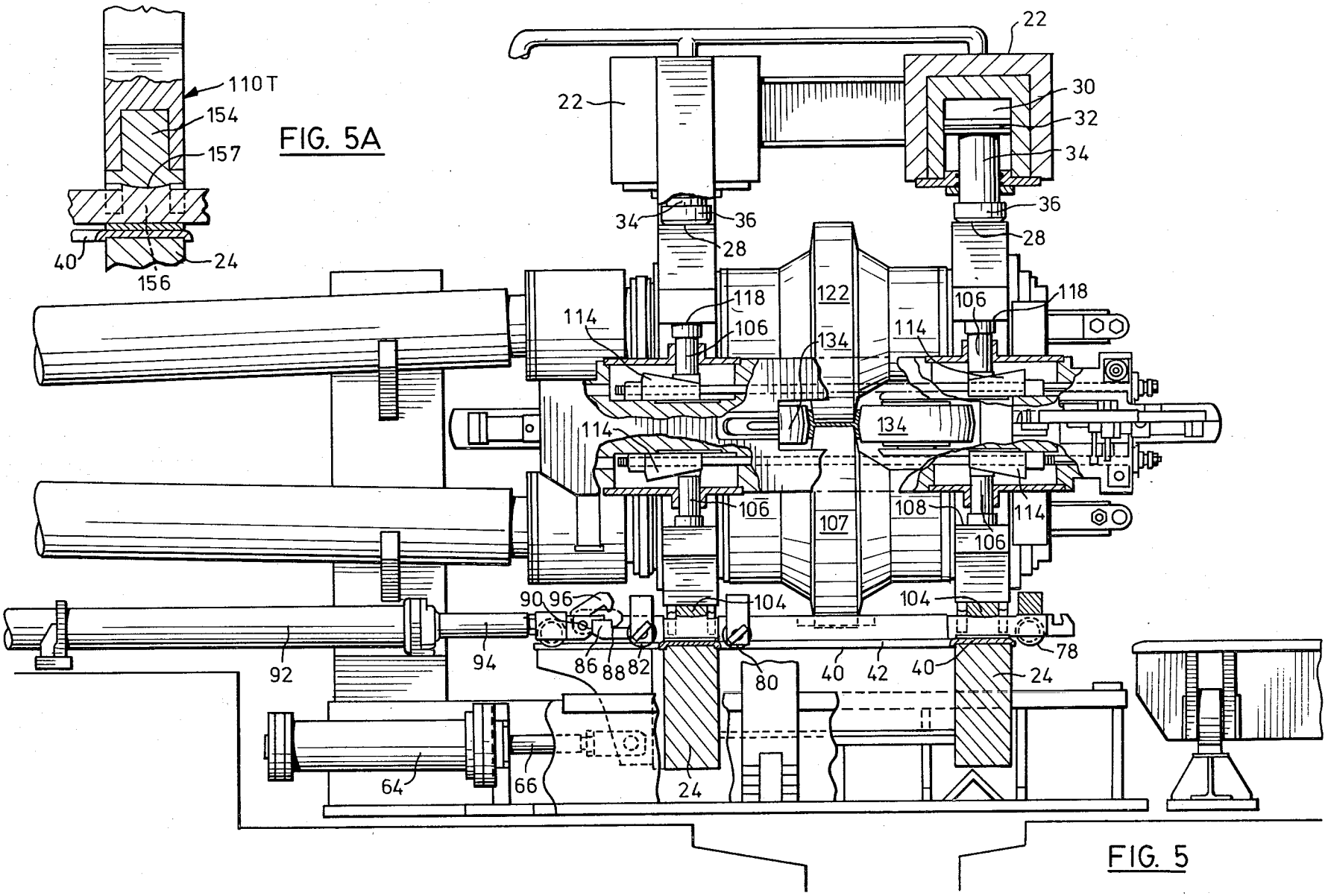
Figure 7:
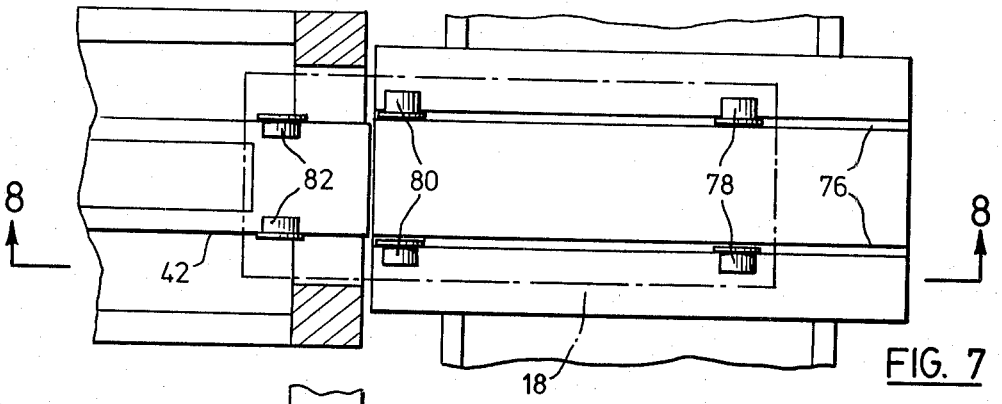
Figure 8:
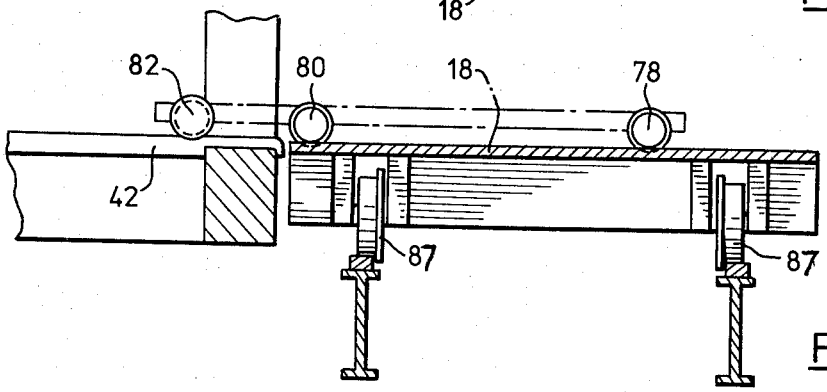
Figure 9:
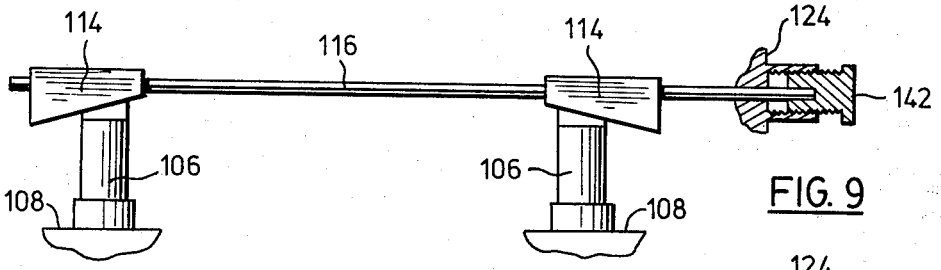
Figure 10:
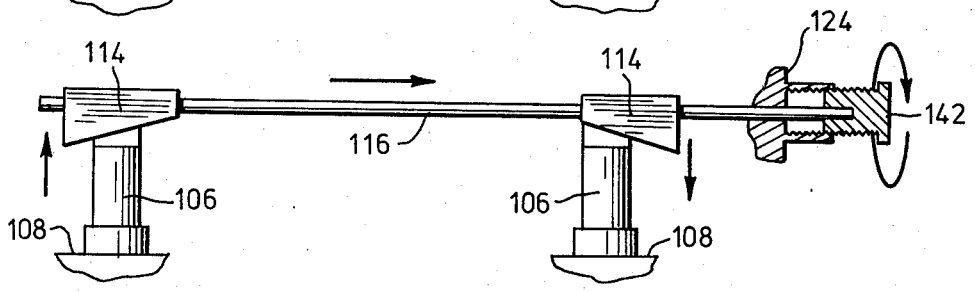

In drawings which illustrate a preferred embodiment of the invention:

FIG. 1 shows a perspective of a mill stand housing with two roll assemblies, in accord with the invention, adjacent thereto, FIG. 1A shows a detail section view along the lines 1A—1A of FIG. 1, FIG. 2 shows the mill stand with a roll assembly installed, FIG. 3 shows an exploded view of a universal roll assembly together with its cart, FIG. 4 shows an exploded view of a two-hi roll assembly together with its cart, FIG. 5 shows partially sectioned side view of universal roll assembly installed in the mill housing, FIG. 5A is a sectional view showing an alternative detail to one shown in FIG. 5, FIG. 6 is a section view showing operation of means for adjusting a roller height or attitude, FIG. 7 is a top view showing the system for transporting the roller assembly cart from the platform to the mill stand housing, FIG. 8 is a section along the lines 8—8 of FIG. 7; and FIGS. 9 and 10 show schematically the operation of means for changing the attitude or height of the rollers.

In FIG. 1 is shown a mill housing 10 standing on a mount 12 and associated with power drive and coupling means schematically indicated at 14, the housing 10 having on one side the roller assemblies 16 and platform 18.

The power drive and coupling means 14 is only shown schematically since the drive means forms no part of the invention. It will be understood that the drive means will supply rotary power to the horizontal rolls in assemblies to be described, will be adapted to couple thereto, and will be designed to have a certain amount of deflection and universal or equivalent movement to allow coupling to the rolls under their tolerable changes in attitude and location in the roll assembly to be described. The mill stand comprises pairs of standards 20 from the base on each side of the steel path P. Each pair of standards is joined on the top at junctions 22 and at the bottom by base member 24. The pair of standards on each side are joined to the other pair on the top by member 56 and at the bottom by base 58 so that the mill stand is a unitary rigid structure and the standards and upper and lower junction members define passage of the relevant portions of the roll assembly from the position of the nearer assembly of FIG. 1 to the position of FIG. 2. Thus the two apertures between the standards in each mill housing 20 allow a roll assembly, being installed, to pass through the nearer aperture to reach its proper location with the upper surfaces 28 on each side of the roll assembly below a respective junction 22 on the mill housing.

As shown best in FIG. 5 the mill housing junctions 22 are provided with piston cylinders 30 containing hydraulically actuable pistons 32 having piston rods 34 terminating at their downward end in pads 36 for bearing downwardly on and clamping the cartridges in place by bearing downwardly on surfaces 28 of the assembly whereas the lower surface of the assembly bears on lower base members 24 of the mill stand.

As shown there are clamp members 26 for horizontally retaining the roll assemblies in place when they are installed in the mill stand as best shown in FIG. 2.

A liner plate 40 mounted on the base of the stand 24 and bottom member 58 supports the roll assembly while passing thereover, extending between the base members 24 and the edges of this plate 40 form rails 42 as shown in FIG. 7 and 8.

As shown, the mill stand unit is slidable on base rails 60 which are part of the mount 12. For moving the mill stand on the rails 60 (extending transversely of the intended steel path) there is provided a cylinder 64 connected to the rigid base on which rails 60 are mounted and having projecting therefrom a piston rod 66 connected to the mill housing for sliding the mill housing in accord with the hydraulic force supplied by the piston 64. This transverse motion may be achieved by alternative means. Clamping means are provided for clamping the mill housing in the desired position on the rails 60 and this clamping means is shown schematically as the clamping plate 68 hinged at 70 and the clamping nut 72 connected to block 74 so that the nut may be tightened to clamp the mill housing in position on rails 60. This clamp may be of alternative construction.

FIG. 1 shows two roll assemblies mounted on a platform 18 and the construction of these roll assemblies will be described hereafter. At this time these roll assemblies will be described as units, it being noted that, as illustrated, such roll assemblies comprise a nearer universal assembly 44U and a farther 'two-hi' stand 44T.

As best seen in FIG. 1 platform 18 defines two pairs of rails in each pair the 'rail' being the outer vertical surface of groove 76. As shown, front and middle ('front' and 'middle' are relative to the view of FIG. 1) pairs of wheels 78 and 80 on the roll assembly roll in grooves 76 with wheel treads outside of the flanges. On the rear side of the roll assembly are outwardly flanged wheels i.e. having threads inside of the flanges, 82 designed to roll on the edges of plate 40 when aligned therewith. It is important to note that the wheels 78 and 80 on the roll assembly are designed to be spaced widely enough apart that they do not contact the plate 40 for lateral guidance and having short enough flanges that they do not contact the base 24 under the mill stand aperture when the roll assembly is travelling into the apertures with the front of the assembly supported by wheels 82 and the rear of the assembly supported by wheels 78. When the roll assembly is in place in the mill housing the assembly is resting as best shown in FIG. 5 with the bottom surface of the cart resting firmly on mill housing base 24 with the forward and middle pairs of wheels 82 and 80 on each side of one base 24 and wheels 78 on the other side of the other base 24. In this position no loads are carried by the wheels.

As shown in FIGS. 1 and 8 the platform 18 is provided with wheels 87 running on rails 89 on an anchored base. A piston cylinder 90 connected at one end to the base controls the location of a piston and rod (not shown) connected to the platform and thus the positioning of the platform relative to the mill stand may be controlled by hydraulic control of the cylinder. Other means of controlling the position of the platform relative to the mill stand may equally be used. A central rail 91 is provided parallel to rails 89 and perpendicular to the rails 42. Four wheels 93 mounted as widely spaced pairs on the underside of platform 18 maintain the platform in its path and wheels 87 on rails 89. The cooperation of a pair of such wheels 93 with rail 91 is indicated in FIG. 1A.

In operation, to install a roll assembly, the platform is moved by cylinder 90, or other means, to position the roll assembly and its tracks with rails 76 aligned with the apertures in the mill stand and equally spaced on each side of the edges (i.e. rails) 42 of plate 40.

At the same time the clamps 68 on the mill stand frame are released and the mill stand is moved in the desired manner by operation of cylinder 64 and rod 66 over to the edge of the slides 60 on which it moves nearest to the platform 18 and would be there clamped in position by clamp 68. As will be noted from FIG. 5 the end of the assembly adjacent the mill stand is provided with an outwardly standing member 86 having an upraised coupling surface 88 facing the assembly and upright end surface 90 parallel thereto. A piston 92 mounted on the mill stand frame is designed to control the extension of a piston rod 94 on the outer end of which is provided a pivotally mounted dog 96 having a surface facing piston 92 to couple to surface 88 for movement of the cart onto the mill housing under leftward movement of the rod 94 and the piston rod 94 is also provided with a fixed surface bearing on the end surface 90 of cart 18 is for movement of the cart off the platform under the impulsion of rod 94. Other means of propulsion may equally be used.

Accordingly when it is desired to move the cart 18 onto the mill stand the piston rod 94 is extended and the dog 96 coupled as indicated in FIG. 5 and the piston rod retracted to draw the cart into position so that the cart reaches the position as shown in FIG. 5. In such a position, as indicated, the clamping means 34–36 in the junction members on each side of mill frame are actuated to clamp the assembly hereafter to be described against the base members 24 of the mill frame.

The mill frame with the assemblies clamped in place may therefore be returned to its proper position for steel line by loosening clamp 68 clamping the mill housing to slides 60 followed by the operation of piston rod 66 to return the housing to its position on the steel line, after which it is clamped by clamp 68.

When it is desired to remove a roll assembly from the mill stand, the mill stand is unclamped at clamp 68 and by the operation of piston rod 66 is moved t the ends of slide 60 adjacent the platform. The platform 18 is located by operation of cylinder 90 to align empty tracks 70 thereon with the tracks on the edge of plate 40 on the mill stand.

The clamping of the roll assembly in the mill stand is then removed by raising clamps 36 and clamping brackets 26 are withdrawn. The piston rod 94 is then extended and its outward end fitted against the upward end of the assembly whereupon the piston rod 94 may be extended to move the assembly off the mill stand and on to the cart. Wheels 82 act to carry the cart on the mill stand and wheels 78 and 80 act to carry the cart on platform 18 as before described. The cart 18 may then be moved to another position for supplying a new roll assembly to the mill stand as hereinbefore described.

The travel of the cart from the platform 18 to the mill stand 24 in the position of FIG. 1 but with reference to the side view of FIG. 5, will now be described. As the roll assembly is drawn toward the mill stand by piston rod 94 the central and rear wheels 78 and 80 move in the rails 76 adjacent the mill stand edge, the forward wheels 82 of the cart contacted and ride on each side of the rails on the edge of plate 40, supporting the weight of the forward end of the cart. Thus when the middle wheels 80 leave the platform 18 they no longer support the cart clearing the outsides of the edges of plate 40 and the mill stand 24 therebelow. Thus as the cart continues to travel on to the mill stand, then it will be noted that as the wheels roll over the first encountered mill stand member 24 and beyond on plate 40, they lift the middle wheels 80 high enough so that these clear the (right hand in FIG. 8) member 24. After the wheels 78 clear the platform, it will be noted that the front end (right in FIG. 8) of the fixed portion of the roll assembly slides on the plate 40 and as the drive side wheels 82 clear the plate 40 the drive end portion of the fixed portion of the roll assembly also rides on the plate 40 to the correct position which may be fixed in any desired manner but it is shown here as fixed by the projections 100 contacting the nearest sides of standards 20 on each side of the roll assembly, the roll assembly is then locked against movement to the left in FIG. 1 by projections 100 bearing on the standards and it is locked against movement to the right by adjustment and tightening of the plate 26 over the end of the roll assembly to hold the roll assembly in place as shown in FIG. 2.

There will now be described the construction of the roll assemblies. In FIG. 3 is shown, a mill stand for a universal configuration which construction comprises the sled or cart 102 carrying the 2 sets of wheels 80 and 78 for riding on rails 76 and the forward set of wheels 82 designed to roll on rails 42. The sled 102 is provided in the universal stand with curved rocker pads 104 which are convex downward when viewed transversely when shown in FIG. 5 and which rest (un-connected) in corresponding concave shapes in the chassis 102 body. Above this is located the sub-assembly body 110 for the lower horizontal roll 107 mounted in bearings and connectable to the power drive all by means not shown in detail as they are well known to those skilled in the art. Guides and strippers not shown are provided in the assembly also as well known to those skilled in the art.

As shown in FIGS. 5 and 3 four plungers 106 slidably mounted in a central member 112 respectively rest on for upwardly facing abutments 108 on the body 110 of the lower horizontal roll member. A plunger 106 with its corresponding abutment 108 is located on each side of each end of the axis of roller 107.

Returning to FIG. 3 we noted that the horizontal roll 107 is mounted in bodies 110 for rotation and with bearings not shown since they are well known to those skilled in the art.

A central body 112 slidably mounts the four plungers 106 just described and the upper end of each plunger bears upwardly on a wedge member 114. Thus a cooperating wedge and plunger combination is located on each side of each end of lower horizontal roller 107 and thereabove. The lower surfaces of each pair of wedges, which are on one side of the roller 107 slope upwardly and inwardly and rest on correspondingly shaped faces of the plungers 106. The pairs of wedges 114 are mounted for sliding parallel to the axis of roll 107 and for threaded connection to a rod rotatably mounted in the central body 112. Rotation of rods 116 controls the positioning of wedges 114 as hereinafter described.

In the universal assembly of FIGS. 3 the wedge and plunger assembly is duplicated in inverted order toward the top of central member 112. That is two more rods 116 are provided, on each side (in plan view) of the axis of roll 122T and each rod controls the position of a pair of wedges 114 having upwardly directed faces sloping inwardly and downwardly (see FIGS. 5, 9 and 10). And the wedges respectively control the position of four plungers 106 slidable thereon which bear on the downwardly facing surfaces of abutments 118 of the upper horizontal body 120 which mounts upper horizontal roll 122T in a manner, and with guides and strippers as required, well known to those skilled in the art. Thus the upper rods 116, upper wedges 114 and vertically slidable plungers 18 are the same as for the lower wedges and the cooperation of the plungers with abutments 118 of the upper roll frame is the same as for the lower, but with the operational portions inverted, making a total of eight wedges and plungers. The upper plungers 106 are aligned with lower plungers 106.

The use of the wedges to adjust the attitude and spacing of the roll will be discussed in connected with the lower set of wedges 114 and the lower roll mounting, it being understood, that the operation of the upper wedges 114 on the upper plungers 106 will be similar with the parts inverted. The lower rotatable rod 116 at its right end in FIG. 5 is shown in FIG. 6 having a block 120 fixed to the wedge 114 by threading connection 122 shown. In the block 120 internal threading is provided to cooperate with the threading on the rod 116 so that in the Figures shown, the rod 116 is turned in one direction the wedge is moved to the right and in the other direction the wedge is moved to the left. The rod block threading is in a reverse sense at the other end of the rod so that rotation of the rod moves the two wedges thereon together or apart.

To adjust the height, in this case the height of the central frame above the lower body there is provided a worm wheel 124 keyed to the rotatable shaft 116 at 126 and driven by a worm gear 128 on shaft 130 mounted on the central frame, rotation of the rod 116 in one direction by worm 128 moves the wedges together since the wedges are provided with opposed senses of thread. Motion in this direction will raise the plungers and will raise the height of the central frame relative to the lower. It being noted that a worm 128 is mounted on each end of rod 130 so that rotation of rod 130 by a wrench at 132 moves four wedges i.e. two edges on each side of the central frame together (to raise the central frame) or apart to lower the central frame. Rotation of the worm wheel 128 in the opposite direction moves the wedges apart lowering the plungers relative and the upper rail frame relative to the central frame.

In the universal configuration shown in FIG. 3, the central frame mounts vertical rolls 134 which are idler rolls. It will be necessary to adjust not only the height, but also the attitude of these relative to lower roll 107 (and upper roll 122). For adjusting the attitude of the central frame and its vertical rollers relative to lower roll (and the upper roll relative to the central frame) there is provided means for shifting each rod 116, individually longitudinally, with the wedge and relative to the central frame and to the plungers and relative to the worm wheel and worm gear. Thus the rod 116 is slidable longitudinally relative to the worm wheel and only keyed thereto. The rod 116 is shown as provided with a shoulder 140 which faces and abuts against the corresponding shoulder in a sleeve 142 the projecting reduced shaft 116R projecting through the sleeve is provided with a nut 144 and a washer 116 which are designed to be locked against the end of the sleeve 142.

The sleeve 142 is threadedly mounted in worm wheel 124 to progress, through rotation, to the right or the left in relation thereto the worm wheel being held against rotation with the sleeve by worm 128.

It will be noted that the sleeve 142 is provided with a number—here four bores 146 open to the outside for insertion of an appropriate torque tool to apply turning force to the sleeve 142. When the sleeve 142 is turned to progress to the left relative to worm wheel 124, the sleeve shoulder bears on shoulder 140 of the rod 116 moving the rod and both its wedges to the left in the drawings. When the sleeve 142 is turned to progress to the right it may bear on nut 144 to move nut 144 and rod 116 to the right. Movement of the rod 116 to the right moves its wedges to the right. As best shown in FIG. 10 movement to the right tilts the right hand wedge 114 and the right hand side of the central frame (on the near or far side) downward while the left hand wedge 164 and the left hand side of the central from (on the same near or far side) upward. Movement of the rod 116 to the left in FIG. 10 produces the tilt of rod 116 and the central frame member in the opposite direction. Since a rod and pair of wedges are provided on each side, parallel and downwardly directed on the central frame member, the central frame member may have its attitude changed by tilting each of the four lower corners relative to the corresponding corner on the other side or on the other end of the frame. Thus, by adjusting the attitude of the central frame as above described, the attitude of the vertical rollers 134 may be adjusted relative to the attitude of lower roller 107. Since the rods 116 are provided with upwardly directed wedging surfaces and plungers for controlling the height and attitude of upper horizontal roller 122 relative to the vertical rollers 134, the parts are inverted but operate in a similar manner. A worm 128 and shaft 130 are provided for controlling the height through all four of the upper wedges and plungers and each upper rod 116 may be moved as above described to control the attitude of the upper roll 122 relative to vertical rolls 134.

It will be noted that the controls for adjustment of the height and attitude of the frames relative to each other are easily adjusted from outside the assembly. Moreover it will be noted that such height and attitude may be adjusted before the assembly is installed in the mill housing so that on line delays, for this reason, are avoided. On the other hand the arrangement of the adjustment means and their accessibility allows the adjustment of such assemblies while in the mill stand if desired. It should be noted that attitude adjustment utilizing threaded sleeve 142 is not normally required and is provided only to allow for compensation of uneven wear in the various components.

FIG. 4 shows a roll assembly designed for a two-high configuration having upper and lower horizontal rolls but no vertical rolls. Since there are no vertical rolls the central frame 112T need not be adjusted relative to the lower roll mounting body 110T so the lower rods, wedges and plungers are omitted and transverse grooves 150 in the body seat the central member 112 firm relative to lower body 110 by seating about the lower roll member which defines surface 108. The upper roll mounting member 120T is adjusted relative to central frame 112 by rods and wedges as described in connection with the position of the universal configuration of FIG. 3. It will also be noted that, in FIG. 4, the upper and lower horizontal rolls 122T and 107T are differently shaped to rolls 122 and 107 and these may of course be selected, in either case, of any desired shape to suit the shape or shapes to be rolled. In addition FIG. 4 shows an alternative arrangement to FIG. 3 where the rolls are smaller than that designed to be encompassed by the upper and lower roll mounting frame and the central member, a filler member 154 is provided designed on its upper surfaces to seat in and register with the lower surfaces of the lower roll mounting member and on its lower surface to rest on the chassis. For this alternative no separate pad 104 is provided but a similar member 157 FIG. 5A is incorporated in the groove 156 and designed to set in a groove in the chassis in a similar manner to the pad 104 of FIG. 5. The pad and chassis are designed so that these members transfer the stress between the filler and chassis.

In relation to the roll assembly design, as described in FIGS. 3 and 4, the earlier description described the application of clamping force from the mill housing through the roll assembly to the mill housing base. As best visualized from FIG. 5 this clamping stress is transferred (in the configuration of FIG. 3 from surface 28 through upper plungers 106 upper wedges 114, the central frame, lower wedges 114, lower plungers 106, lower roll from surfaces pads 104 to chassis 102 to housing base 24. In the configuration of FIG. 4 the stress is similarily transferred down to the central frame and then is transferred from the central frame through the lower roll mounting, filler 154, if used, to chassis 102 to base 24.

I claim:

1. Mill stand for steel rolling mill comprising:
a mill housing rigidly connected to a base,
a roll assembly,
said mill housing and said roll assembly being designed and constructed to allow said roll assembly to be installed in and removed from said mill housing on relative motion transverse to the intended path of steel through the mill housing,
said mill housing comprising:
a pair of standards on each side of the intended steel path therepast,
each said pair of standards being structurally joined by a junction member adjacent their upper ends,
at least one of said pairs with its junction member defining a window for movement of a roll assembly into and out of said path,
hydraulically actuated piston means associated with each said junction member for exerting a downward pressure on a roll assembly mounted in said housing,
said roll assembly comprising,
a lower horizontal roll mounting member,
an upper horizontal roll mounting member designed to rest on and be supported by said lower horizontal roll mounting member,
means in said assembly for adjusting the height and axial attitude of said upper roll relative to said lower roll while said assembly is outside said housing,
said assembly being designed to be moved approximately horizontally into a mill housing,
means in said assembly for adjusting the height and axial attitude of said upper roll relative to said lower roll, while said assembly is outside said housing,
said roll assembly being so designed that, when installed, each said piston means may be hydraulically actuated to exert pressure,
to clamp said upper horizontal roll assembly downwardly against said lower horizontal roll assembly.

2. Mill stand as claimed in claim 1 including in said roll assembly an intermediate member designed to rest on and be supported by said lower horizontal roll mounting member, and wherein said upper horizontal roll mounting member is designed to rest on and be supported by said intermediate member.

3. Mill stand as claimed in claim 2 wherein said intermediate member is provided with spaced vertical rolls arranged and designed to cooperate with such horizontal rolls in steel rolling.
and wherein said means for adjusting the height and attitude includes means for adjusting the height and attitude of said intermediate member relative to said lower roll member and means for adjusting the height and attitude of said upper roll member relative to said intermediate member.

4. Means for adjusting, upper and lower horizontal rolls and vertical rolls in a steel rolling mill, wherein there are provided a lower roll mounting member, a vertical roll mounting member designed to rest on said lower roll mounting member, but adjustable relative thereto, an upper roll mounting member designed to rest on said vertical roll mounting member but adjustable relative thereto, adjustment means between said lower roll member and said vertical roll member and adjustment means between said vertical roll member and said upper roll member,
wherein each said adjustment means comprises four first wedge surface on one member, each respectively cooperating with one of four second wedge surfaces on the other member to provide at each cooperating pair a vertical wedging effect on relative movement therebetween in a direction approximately parallel to the direction of the axes of the horizontal rollers, said pairs of cooperating surfaces acting as the support of the upper roll mounting member on the lower member, with a pair of cooperating surfaces on each side of the upper roll axes and there are provided means for moving either pair of said first wedges toward or away from each other or to displace either of said pairs of first wedges longitudinally relative to said rolls.

5. Means as claimed in claim 4 wherein said wedges in a pair are arranged to slope in opposite directions.

6. Mill stand for steel rolling mill comprising:
a roll assembly,
a mill housing rigidly connected to a base;
said roll assembly comprising:
a lower horizontal roll mounting member,
an upper horizontal roll mounting member, designed to rest on and be supported by said lower horizontal roll mounting member,
said assembly being designed together with said mill housing to be moved approximately horizontally into said mill housing,
hydraulically actuated means in said housing when said roll assembly is installed therein, for applying downward pressure on each end of said upper horizontal roll mounting member,
including in said roll assembly, an intermediate member designed to rest on and be supported by said lower horizontal roll mounting member, and wherein said upper horizontal roll mounting member is designed to rest on and be supported by said intermediate member,
wherein said intermediate member is provided with spaced vertical rolls arranged and designed to cooperate with such horizontal rolls in steel rolling,
and wherein said means for adjusting the height and attitude includes means for adjusting the height and attitude of said intermediate member relative to said lower roll member and means for adjusting the height and attitude of said upper roll member relative to said intermediate member.

* * * * *